US005729909A

United States Patent [19]

Chesnutt Robison

[11] Patent Number: 5,729,909

[45] Date of Patent: Mar. 24, 1998

[54] METHOD AND APPARATUS FOR DRYING AN ARTICLE OF CLOTHING

[75] Inventor: Jackie L. Chesnutt Robison, San Angelo, Tex.

[73] Assignee: Chesnutt Engineering, San Angelo, Tex.

[21] Appl. No.: 789,649

[22] Filed: Jan. 27, 1997

[51] Int. Cl.[6] ..... D06F 58/00

[52] U.S. Cl. ..... 34/109; 34/130; 34/239; 34/621; 223/67; 223/74

[58] Field of Search ..... 34/239, 600, 621, 34/103, 109, 130; 223/67, 73, 74

[56] References Cited

U.S. PATENT DOCUMENTS 4,497,423 2/1985 Cummins ..... 223/96

5,276,979 1/1994 Gordon, Sr. ..... 34/133

5,555,648 9/1996 Griffin ..... 34/621

*Primary Examiner*—Henry A. Bennett

*Assistant Examiner*—Pamela A. O'Connor

*Attorney, Agent, or Firm*—Richard K. Robinson

[57] ABSTRACT

A clothes drying apparatus has the general shape of a drying sleeve with sufficient length and width to hold an article of clothing for drying. The article of clothing is placed in the drying sleeve and synch lines on each end of the drying sleeve are closed thereby retaining the article of clothing inside of the drying sleeve. The drying sleeve can then be hung out to dry.

9 Claims, 2 Drawing Sheets

METHOD AND APPARATUS FOR DRYING AN ARTICLE OF CLOTHING

BACKGROUND OF THE INVENTION

This invention relates to an apparatus for drying an article of clothing so that the clothing will maintain its original shape. In particular, this invention relates to a drying sleeve and method for drying an article of clothing that has a multiplicity of pleats.

Periodically, it becomes very popular for women to wear pleated skins. Currently, "broomstick" or "crinkle" skirts are being worn by women as both their casual and business dress. The popularity of these skirts is because of comfort, ease of care and the ability to hide extra weight of the person wearing the skirt.

An example of such an article of clothing is illustrated in FIG. 1, to which reference should now be made, illustrating a "broomstick" skirt 10. The "broomstick" skirt 10 has a multiplicity of pleats 12 separated periodically by stitch lines 13 and 15. At the top of the skirt there is a waistband 17 provided for retaining the skirt around the waist.

The manufacturers of the "broomstick" or "crinkle" skirts recommend, in their care instructions, that the skirt may be washed and after washing it should be twisted and tied in a knot to maintain its preferred shape when dried. Because the ends of the skirt are left hanging out of the knot, the skirt rarely retains the original desired look. Consequently, in order for the skirt to have some resemblance of the desired look, the wearer will often have to invest in the expense of dry cleaning the article of clothing. This added expense diminishes the benefits touted by the manufacturers of the "broomstick" or "crinkle" skirts.

Accordingly, the advantage of this invention is that it will put the article of clothing back into its original configuration and reduce the need for dry cleaning (unless dry cleaning is required by the type of material used to manufacture the article of clothing). The clothes dryer can be used to store the article of clothing when not being worn, facilitates travel because of its ability to be folded and packed into a suit case even when the clothes dryer contains an article of clothing, is a reusable and, as an additional advantage, the clothes dryer can be used for dry-cleaning purposes.

SUMMARY OF THE INVENTION

A clothes drying apparatus having the general shape of a drying sleeve with sufficient length and width to hold an article of clothing for drying. The article of clothing is placed in the drying sleeve and synch lines on each end of the drying sleeve are closed thereby retaining the article of clothing inside of the drying sleeve. The drying sleeve and article of clothing can then be hung up to dry.

The material that is used to make the drying sleeve is made of a material having a weave that facilitates the transfer of moisture from the inside of the sleeve to the outside of the sleeve such as a fish netting that has a retention memory enabling the drying sleeve to retain its shape. The elasticities enable the width of the drying sleeve to increase when the length of the drying sleeve is compressed so that one may place an article of clothing within the drying sleeve for drying. The retention of the plastic material is strong enough to hold the article within the drying sleeve causing only a minimal amount of deformation of the drying sleeve. The stronger the retention of the drying sleeve, the more preferred the material will be. However, it has to be deformable so that the article of clothing may be placed within the drying sleeve.

DETAILED DESCRIPTION OF THE EMBODIMENTS

Figure 1:
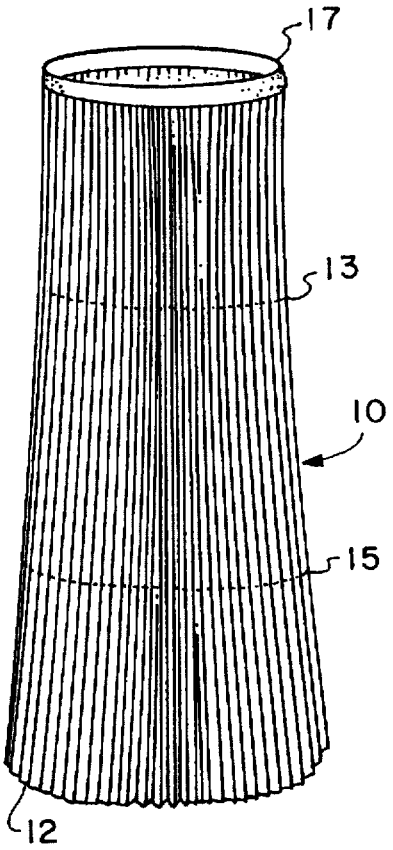
FIG. 1 is a diagram of an article of clothing that can be dried according to the invention.
Figure 2:
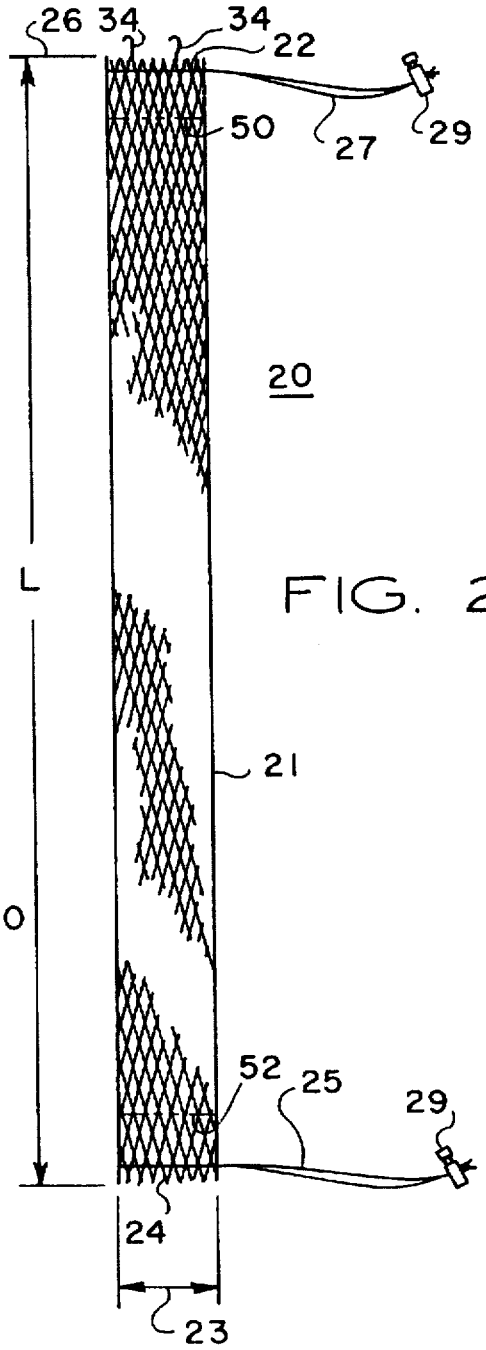
FIG. 2 is a diagram of the clothes drying apparatus according to the invention.

In FIG. 2, to which reference should now be made, there is shown an illustration of the clothes dryer 20. The clothes dryer 20 is made from a netting material 21 having a fish net weave and has a general cylindrical shape when opened. There is an opening 22 at one end and at the opposite end there is an opening 24. A synch cord 27 is used to close the opening 22 and when closed, a cord stop 29 is used to press against the netting material 21 retaining synch cord 27 tightly around the compressed opening 22. Similarly, the opening 24 can be closed by the placement of the cord stop 29 firmly against the netting material 21 to close the bottom opening of the clothes dryer 20. Dimension lines 26 represents the length (L) of the drying apparatus which, for the purposes of drying the "broomstick" skin, is approximately four feet in length and the width (W) as shown by dimension line 23 and is four inches in the illustrated embodiment. However, this length and width need only be long enough and wide enough to ensure that the article of clothing can hang straight when placed within the clothes dryer 20 without being compressed by either of the synch cords 27 and 25.

The netting material 21 is preferably a non-moisture absorbent material such as plastic and it can be that material manufactured by Naltex and referred to as Flex-Guard™ IV 407 and is available from Nalle Plastics, Inc. in Austin, Tex. The advantage of this material is that firstly it is nonabsorbent and that enables the clothes inside the clothes dryer 20 to dry more uniformly. Secondly, when the length (L) is compressed the opening either 23 or 24 increases to facilitate the insertion of an article of clothing such as that shown in FIG. 3 within the clothes dryer 20.

The netting material 20 preferably has a retention memory that allows it to maintain its shape or return to its original shape shown in FIG. 2 after deformation. The strength of the retention must be strong enough to hold the article of clothing 10 in place when the clothes dryer 22 is synched closed at both ends.

The netting material 20 has an elasticity to allow the spreading of the open ends 22 and 24. The open ends must open wide enough so that a person's hand may reach through the clothes dryer 22 to grasp the article of clothing 10 and pull it through the opened end 24 and up to point 50 but not through the opened end 22. In the preferred embodiment, the article of clothing 10 should be retained between points 50 and 52.

Hooks 34 facilitate the hanging of the drying apparatus when it is placed on a line not shown.

Figure 3:
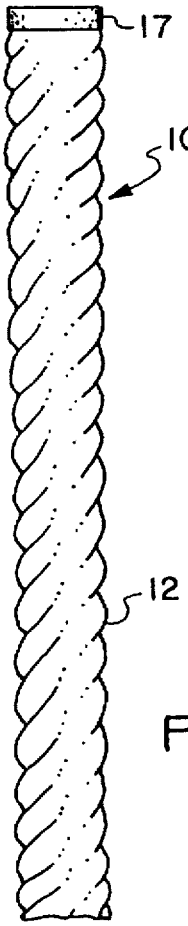
FIG. 3 is a diagram of the article of clothing in FIG. 1 being put into position for placement within the apparatus according to the invention.
Figure 4:
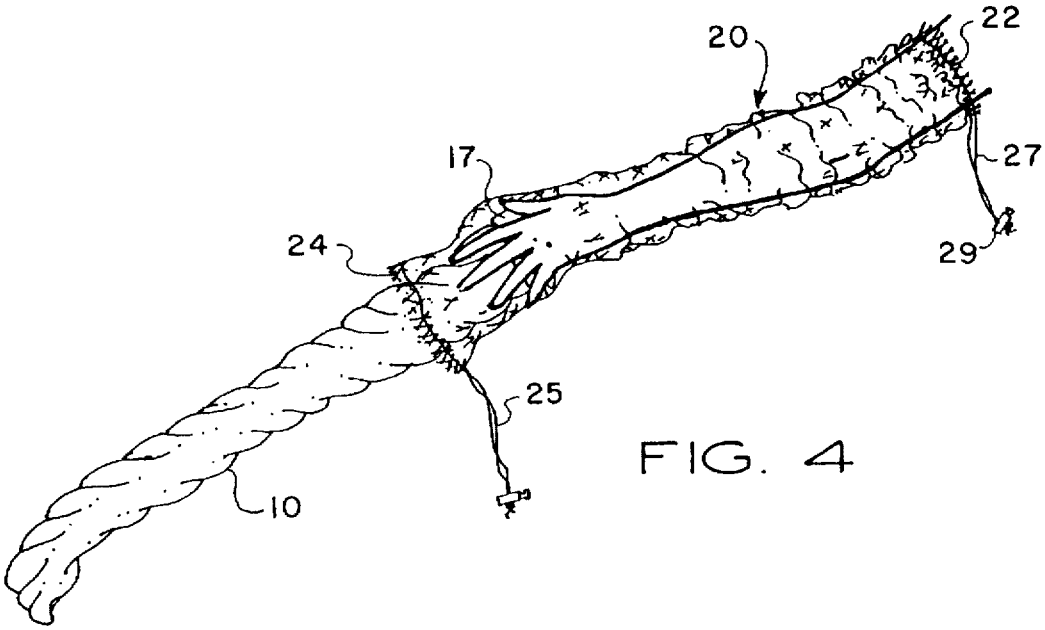
FIG. 4 illustrates the use of the clothes drying apparatus according to the invention.
Figure 5:
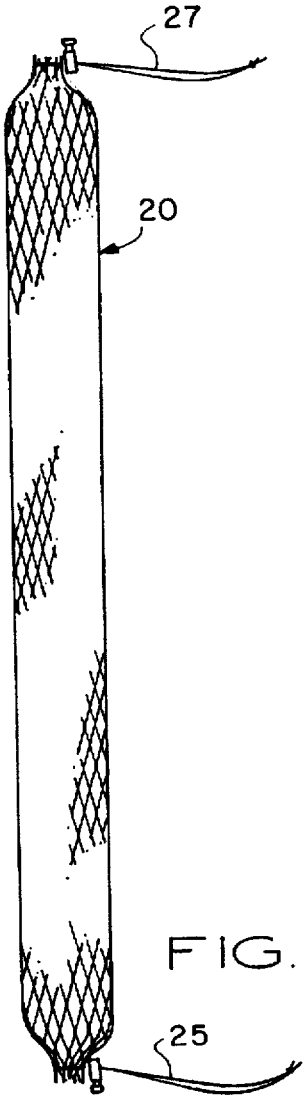
FIG. 5 is a diagram of the clothes drying apparatus with an article of clothing placed therein in the synched position; and, FIG. 6 is an alternate embodiment of the invention.

FIG. 4 is an example where the skirt 10, shown in FIG. 3 in the twisted form, is pulled through the opening 24 into the clothes dryer 20 after which the synch lines 27 and 25 are closed locking the article of clothing 10 within the clothes dryer 20. This is illustrated in FIG. 5.

Figure 6:
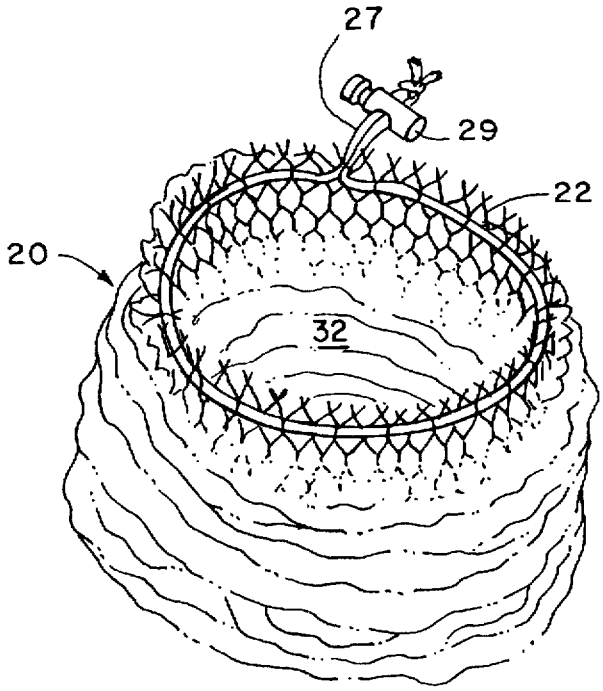

FIG. 6 is an alternate embodiment of the invention wherein there is only one open end 22 and illustrates the invention where the length (L) is compressed and the mouth 22 of the clothes dryer 20 is open. In this embodiment, the invention may be practiced in two ways. The first way is to place the twisted article of clothing 10 into the sleeve shaped clothes dryer 20 and holding one end, close the opening 22.

An alternate method to practice the embodiment of FIG. 6 is to place one hand into the opening 22 in the clothes dryer 20 grabbing the bottom 32 of the clothes dryer 20 and article 10 within the outside of the bottom 32 of the clothes dryer 20 and withdrawing the hand through opening 22 turning the clothes dryer 20 inside out resulting in the article 10 being within the clothes dryer 20.

I claim:

1. A clothes drying apparatus comprising:

a sleeve having a predefined length and width and a first synch on a first open end of the sleeve, the sleeve being made of a nonabsorbent material having a weave that facilitates the transfer of moisture from the inside of the sleeve to the outside of the sleeve of the clothes drying apparatus.

2. The clothes drying apparatus according to claim 1 wherein the material has a retention memory that retains a shape of the sleeve defined by the predetermined length and width and an elasticity that enables the width to increase when the length of the sleeve is compressed.

3. The clothes drying apparatus according to claim 2 wherein the sleeve further includes a second synch on a second open end on the sleeve having the predefined width and separated from the first open end by the length.

4. The clothes drying apparatus according to claim 3 wherein the sleeve further includes an article within the sleeve, the retention of the sleeve holds the article at a predefined shape when the first and second synchs are tightened.

5. The clothes drying apparatus according to claim 3 wherein the weave is a fish net weave and the material is a plastic material.

6. The method for drying an article of clothing comprising the steps of:

placing the article in a sleeve having a predefined length and width and a first synch on a first open end of the sleeve, the sleeve being made of a nonabsorbent material having a weave that facilitates the transfer of moisture from the inside of the sleeve to the outside of the sleeve of the clothes drying apparatus and, tightening the synch; and hanging the sleeve and article to dry.

7. The method according to claim 6 selecting a sleeve material with a retention memory that retains a shape of the sleeve defined by the predetermined length and width and an elasticity that enables the width to increase when the length of the sleeve is compressed and the method includes the step of compressing the sleeve to increase the width of the first open end of the sleeve to facilitate the placement of the article in the sleeve.

8. The method according to claim 7 further includes the step of twisting the article of clothing prior to the placement of the article in the sleeve.

9. The method according to claim 6 wherein the sleeve has an inside position, an outside position and a bottom and the method further includes the step of:

grasping the bottom of the sleeve on the inside position of the sleeve and include the article of clothing on the outside position of the sleeve; and withdrawing the bottom of the sleeve through the first end turning the sleeve inside out leaving the article of clothing inside the sleeve.

* * * * *

UNITED STATES PATENT AND TRADEMARK OFFICE

CERTIFICATE OF CORRECTION

PATENT NO. : 5,729,909

DATED : March 24, 1998

INVENTOR(S) : Jackie L. Chesnutt Robison

It is certified that error appears in the above-identified patent and that said Letters Patent is hereby corrected as shown below:

In Column 1, Line 11 replace "skins", and substitute therefor --skirts--

In Column 2, Line 32 replace "skin", and substitute therefor --skirt--

Signed and Sealed this

Sixteenth Day of June, 1998

*Attest:*

*Attesting Officer*

Bruce Lehman

BRUCE LEHMAN

*Commissioner of Patents and Trademarks*